United States Patent [19]

Russum

[11] 4,452,689

[45] Jun. 5, 1984

[54] HUFF AND PUFF PROCESS FOR RETORTING OIL SHALE

[75] Inventor: Leonard W. Russum, Batavia, Ill.

[73] Assignees: Standard Oil Company (Indiana), Chicago, Ill.; Gulf Oil Corporation

[21] Appl. No.: 394,681

[22] Filed: Jul. 2, 1982

[51] Int. Cl.[3] ..... C10G 1/00

[52] U.S. Cl. ..... 208/11 R; 166/261; 166/266

[58] Field of Search ..... 208/11 R; 166/261

[56] References Cited

U.S. PATENT DOCUMENTS 3,994,343 11/1976 Cha et al. ..... 166/259

4,353,418 10/1982 Hoekstra et al. ..... 166/259

*Primary Examiner*—S. Leon Bashore, Jr.

*Assistant Examiner*—Joye L. Woodard

*Attorney, Agent, or Firm*—Thomas W. Tolpin; William T. McClain; William H. Magidson

[57] ABSTRACT

Greater product yield and quality as well as simplified gas recovery can be attained by a huff and puff process for retorting oil shale. The process can be advantageously carried out in in situ retorts under ground as well as in surface retorts above ground. In the process, an active retort of raw oil shale is retorted without prior combustion of oil shale therein with retort off gases, which have been heated in a spent shale retort. In the preferred mode, retort off gases from the active retort and air are alternately injected into the spent retort to cyclically heat the off gases and combust the coked shale. The retort off gases can be deoiled and optionally scrubbed of carbon dioxide and hydrogen sulfide before being heated in the spent retort.

8 Claims, 3 Drawing Figures

HUFF AND PUFF PROCESS FOR RETORTING OIL SHALE

BACKGROUND OF THE INVENTION

This invention relates to a process for retorting of oil shale.

Researchers have now renewed their efforts to find alternative sources of energy and hydrocarbons in view of recent rapid increases in the price of crude oil and natural gas. Much research has been focused on recovering hydrocarbons from solid hyrdocarbon-containing material such as oil shale, coal and tar sands by pryolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil is contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil, water, and light hydrocarbon gases, such as methane, ethane, ethene, propane and propene, as well as other products, such as hydrogen, nitrogen, carbon dioxide, carbon monoxide, ammonia, steam and hydrogen sulfide. A carbon residue typically remains on the retorted shale.

In order to obtain high thermal efficiency in retorting, carbonate decomposition should be minimized. Carbonate decomposition consumes heat, lowers thermal efficiency and decreases the heating value of off gases. Colorado Mahogany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if all these minerals were allowed to decompose during retorting. Saline sodium carbonate minerals also occur in the Green River formation in certain areas and at certain stratigraphic zones.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts under ground. In situ retorts require less mining and handling than surface retorts.

In in situ retorts, a flame front or an inert feed gas is passed downward through a bed of rubblized oil shale to liberate shale oil, off gases and residual water. There are two types of in situ retorts: true in situ retorts and modified in situ retorts. In true in situ retorts, the oil shale is explosively fractured and then retorted. In modified in situ retorts, some of the oil shale is removed before explosive rubblization to create a cavity or void space in the retorting area. The cavity provides extra space for rubblized oil shale. The oil shale which has been removed is conveyed to the surface and retorted above ground.

Air is typically injected into in situ retorts to support the flame front. Air contains appreciable quantities of nitrogen, however, which contaminate the retort gases.

Different sized oil shale fragments, channeling, irregular packing and imperfect distribution of oil shale fragments in underground retorts can cause tilted (nonhorizontal) and irregular, high temperature flame fronts in close proximity to the retorting zone and fingering, that is, flame front projections of high temperature which extend downward into the raw oil shale and advance far ahead of other portions of the flame front. High temperature flame fronts and fingering can cause carbonate decomposition, coking and thermal cracking of the liberated shale oil. Irregular, tilted flame fronts can lead to flame front breakthrough, incomplete retorting and burning of the product shale oil.

In the case of severe channeling, horizontal pathways may permit oxygen to flow underneath the raw unretorted shale. If this happens, all of the oil flowing downward in that zone may burn. It has been estimated that losses from burning in in situ retorting are as high as 40% of the product shale oil.

Typifying the many methods of in situ retorting are those found in U.S. Pat. Nos. 1,913,395; 1,191,636; 2,481,051; 3,001,776; 3,586,377; 3,434,757; 3,586,377; 3,661,423; 3,951,456; 4,005,752; 4,007,963; 4,105,072; 4,117,886; 4,119,349; 4,126,180; 4,133,380; 4,149,752; 4,158,467; 4,169,506; 4,194,788; 4,241,547; 4,241,952 and 4,285,547. These prior art processes have met with varying degrees of success.

It is therefore desirable to provide an improved process for retorting of oil shale.

SUMMARY OF THE INVENTION

A huff and puff process is provided for retorting oil shale. The huff and puff process can be advantageously used in underground in situ retorts or in aboveground surface retorts.

In the process, retort off gases are cycled through and heated in a spent shale retort, to at least the retorting temperature of raw oil shale, before being fed into an active, raw oil shale retort for use as a gaseous heat carrier material. In the active retort, the heated off gases heat the raw oil shale to a sufficient temperature to liberate an effluent product stream of shale oil and light hydrocarbon gases from the raw oil shale. Air and molecular oxygen are substantially prevented from entering the retort to prevent burning of the effluent product stream and nitrogen contamination of the retort off gases, as well as to minimize chances of explosion. Desirably, the off gases are also deoiled in a gas plant and optionally scrubbed of carbon dioxide and hydrogen sulfide before being heated in the spent shale retort.

In the preferred form, retort off gases, most preferably derived from the active retort, and air are alternately injected into the spent shale retort to cyclically heat the retort off gases and combust the coked shale. In the illustrative embodiments, the retort off gases and air are alternately passed upwardly through the spent shale retort, although they could be passed downwardly through the spent shale retort, if desired.

For in situ and surface retorts, the heated off gases are preferably passed downwardly through the active retort. Other gas flow directions can also be used.

The huff and puff process for retorting oil shale has many advantages. Off gases recovered from the huff and puff process have a high heating value (BTU) in comparison to high nitrogen level, off gases recovered from conventional retorting processes. Furthermore, retorting temperatures in the active retort will be maintained for a longer period of time in the huff and puff process, permitting the heat the penetrate large oil shale boulders and less permeable shale zones, so as to minimize the detrimental effects of imperfect rubblization and increase product yield and quality. In conventional in situ processes, a recovery of 65% of the Fischer Assay oil is considered good. In the novel huff and puff process, almost 100% of the Fischer Assay oil can be recovered.

Desirably, much of the carbon dioxide and hydrogen sulfide that is produced in the active retort is reabsorbed in the cooler zone at the bottom of the spent shale retort. Such absorption simplifies off gas scrubbing and recovery and heats the spent retort.

As used throughout this application, the term "retorted shale" refers to oil shale which has been retorted to liberate hydrocarbons leaving an organic material containing carbon residue.

The terms "spent shale" and "spent oil shale" as used herein mean retorted shale from which most of the carbon residue has been removed by combustion.

The terms "spent retort," "spent shale retort" and "spent oil shale retort" as used herein mean a retort containing retorted shale or spent shale.

A more detailed explanation of the invention is provided in the following description and appended claims taken in conjunction with the accompanying drawings.

DETAILED DESCRIPTION OF THE PREFERRED EMBODIMENTS

Figures 1, 2:
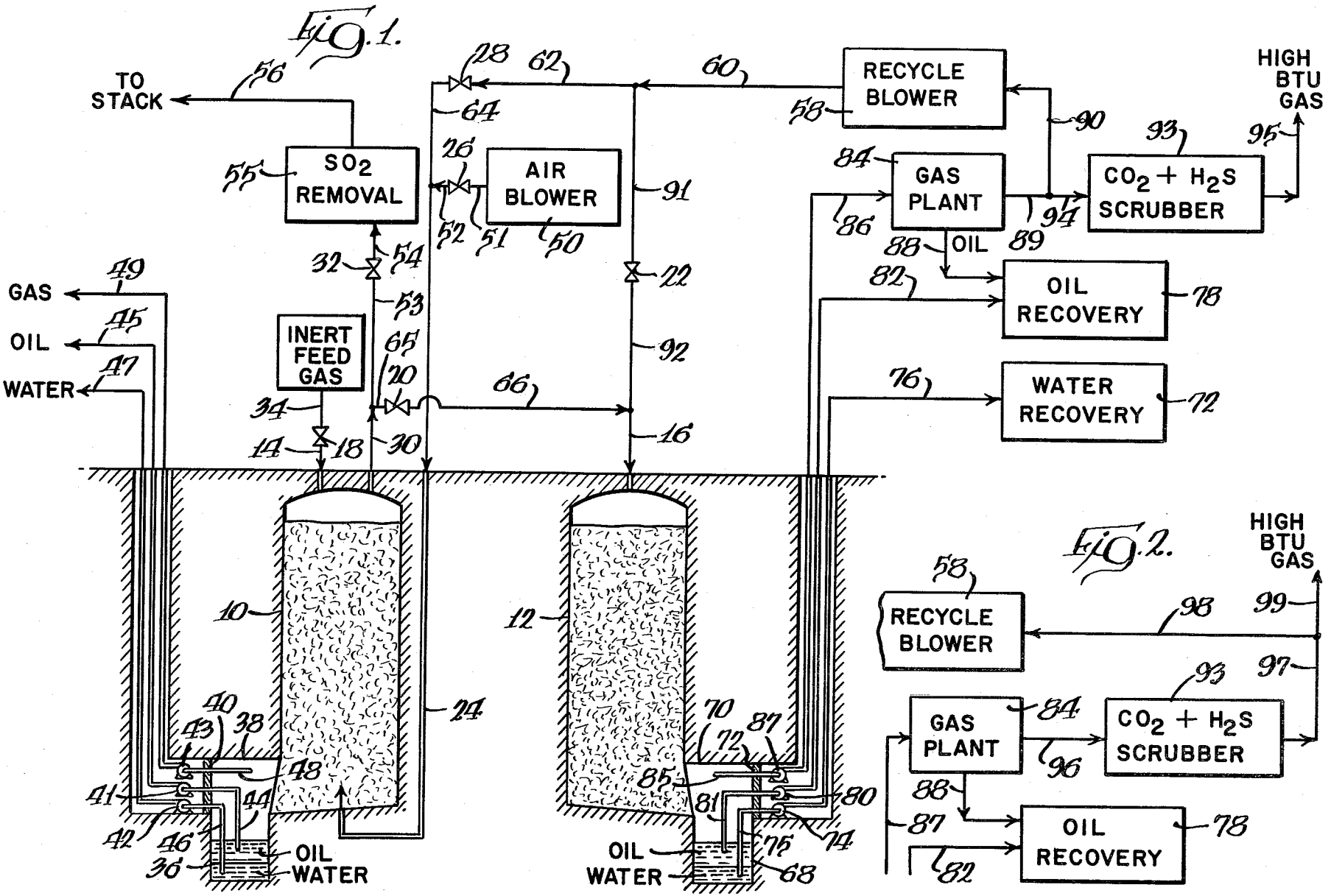
FIG. 1 is a schematic flow diagram of a huff and puff in situ process for retorting oil shale underground in accordance with principles of the present invention.
FIG. 2 is a schematic flow diagram of a modification of FIG. 1.

Referring now to FIG. 1 of the drawings, a pair of underground modified in situ, oil shale retorts 10 and 12 are located in a subterranean formation of oil shale. Retorts 10 and 12 are covered with an overburden and are each elongated, upright and generally box-shaped, with a top or dome-shaped roof.

Retorts 10 and 12 are filled with irregularly packed, fluid permeable, fragmented, rubblized masses of oil shale spaced below the roofs. The rubblized masses are formed by first mining an access tunnel or drift extending horizontally into the bottom of each retort and removing from 2 per cent to 40 per cent and preferably from 15 per cent to 25 per cent by volume of the oil shale from a central region of each retort to form a cavity or void space in the retort. The removed oil shale is conveyed to the surface and retorted in an aboveground surface retort. The mass of oil shale surrounding the cavity is then fragmented and expanded by detonation or explosives to form the rubblized mass in the retort.

Feed gas lines 14 and 16 extend from above ground through the overburden into the top of retorts 10 and 12, respectively. The extent and rate of gas flow through the feed gas lines are regulated and controlled by feed gas valves 18, 20 and 22. Air and recycled off gases are injected into the bottom of retort 10, through a common line 24 and are regulated and controlled by air valve 26 and recycle gas valve 28, respectively. Preferably, the line 24 is purged with an inert gas, such as a stack gas, between the air and recycle gas injections, to avoid explosions.

Heated off gases and combustion gases are discharged from the top of retort 10 through a common overhead line 30 and are regulated by on-off valves 20 and 32, respectively.

In order to retort retort 10, feed gas valve 18 is opened and hot inert feed gas, such as fresh hot retort off gases, steam or carbon dioxide is fed into retort 10 through feed lines 14 and 34. The feed gas passes downwardly through the retort to liberate an effluent product stream of shale oil, retort water and off gases from the raw oil shale. Off gases emitted during retorting include various amounts of hydrogen, carbon monoxide, carbon dioxide, hydrogen sulfide, carbonyl sulfide, oxides of sulfur, and low molecular weight hydrocarbons. The effluent product stream flows downward through the retort and is discharged into a collection basin and separator, such as a sump 36 in the bottom of access tunnel 38. Concrete wall 40 prevents leakage of off gas into the mine. The liquid shale oil, water and gases are separated in collection basin 36 by gravity and conveyed to the surface by pumps 41 and 42 and compressor 43, respectively, through inlet and return lines 44-49 for further processing. The pumps and/or compressor can be located above ground if desired.

Retorted oil shale contains carbon residue or coke which has useful heating value. After the raw oil shale in retort 10 has been retorted, valve 18 is closed, air valve 26 is opened and air from a compressor, pneumatic pump or blower 50 is injected upwardly into the bottom of spent shale retort 10 through lines 51, 52 and 24, respectively, to ignite a flame front which combusts the carbon residue (coke) and heats the retorted shale. Combustion gases emitted during combustion are withdrawn from the top of spent retort 10 through overhead lines 30, 53 and 54 and passed through an optional heat recovery boiler (not shown) before being substantially depleted of $SO_2$ in $SO_2$ removal equipment 55, by opening combustion gas valve 32 and closing recycle gas valve 20. The combustion off gases are then passed through line 56 to a stack and flared or to a cyclone or electrostatic precipitator where the gas is dedusted before being discharged into the atmosphere.

Air being fed into spent shale retort 10 is intermittently and cyclically stopped by repetitively closing and opening valve 26 to alternately quench and reignite the flame front in the spent retort for selected intervals of time. When air is not being fed into spent shale retort 10, i.e., between pulses of air, valve 28 is opened, and valve 26 is closed, to allow recycle gas blower 58 to feed retort off gases from an active, fresh oil shale retort 12, through lines 60, 62, 64 and 24, respectively, into the bottom of spent shale retort 10. The retort off gases from the active retort 12 flow upwardly through the spent shale retort 10 and are heated to at least the retorting temperature of the raw oil shale in spent shale retort 10 and preferably to a temperature ranging from about 900° F. to about 1300° F.

The heated off gases are withdrawn from the top of spent shale retort 10 through overhead line 30 and fed downwardly into the active shale retort 12 via lines 65 and 66, by opening recycle gas valve 20 and closing combustion gas valve 32, to liberate an effluent product stream of shale oil, retort water and off gases from the raw oil shale contained in the active shale retort. The effluent product stream of shale oil, retort water and off gases flows downwardly through active retort 12 and is discharged into a collection basin and separator, such as sump 68 in the bottom of access tunnel 70, where it is separated by gravity. Concrete wall 72 prevents leakage of gas into the mine. Retort water is pumped to water purification and recovery equipment 72 by pump 74 through lines 75 and 76. Shale oil is pumped to oil recovery equipment 78 by pump 80 through lines 81 and 82. Off gases emitted from active retort 12 have a composition similar to the off gases emitted from retort 10 and are pumped to gas plant 84 through lines 85 and 86 by pump 87 or a compressor in gas plant 84. Oil recovery equipment dedusts the shale oil, separates the shale oil into fractions and hydrotreats or otherwise upgrades the shale oil. Gas plant 84 includes a scrubber or other deoiling equipment to remove a substantial portion of any entrained shale oil in the effluent off gases and feeds the removed oil to oil recovery equipment 70 through oil return line 88. In the preferred mode, the gas plant and oil recovery equipment are integrated.

When air is being fed into spent shale retort 10, off gas valve 22 is opened and recycle gas valve 28 is closed to allow recycle blower 58 to feed retort off gases from gas plant 84 back into the top of retort 12 through lines 89, 90, 60, 91, 92 and 16, respectively, to assure continuous retorting of active retort 12.

The net make of the off gases from active retort 12 can be scrubbed or otherwise purified of carbon dioxide and hydrogen sulfide by passing the off gases through lines 89 and 94 into $CO_2$ and $H_2S$ scrubber 93. The low-in-nitrogen-content scrubbed gases are discharged through outlet line 95 for further use downstream.

If desired, the off gases from active retort 12 can be scrubbed or otherwise purified of carbon dioxide and hydrogen sulfide in $CO_2$ and $H_2S$ scrubber 93, via line 96 (FIG. 2), and passed through lines 97 and 98 into recycle blower 58, before the off gases are injected and heated in the spent shale retort and fed into the active shale retort. Some of the purified off gases can be conveyed through outlet line 99 (FIG. 2) for further use downstream.

Horizontal- and irregular-shaped underground retorts can also be retorted by the above huff and puff processes.

Figure 3:
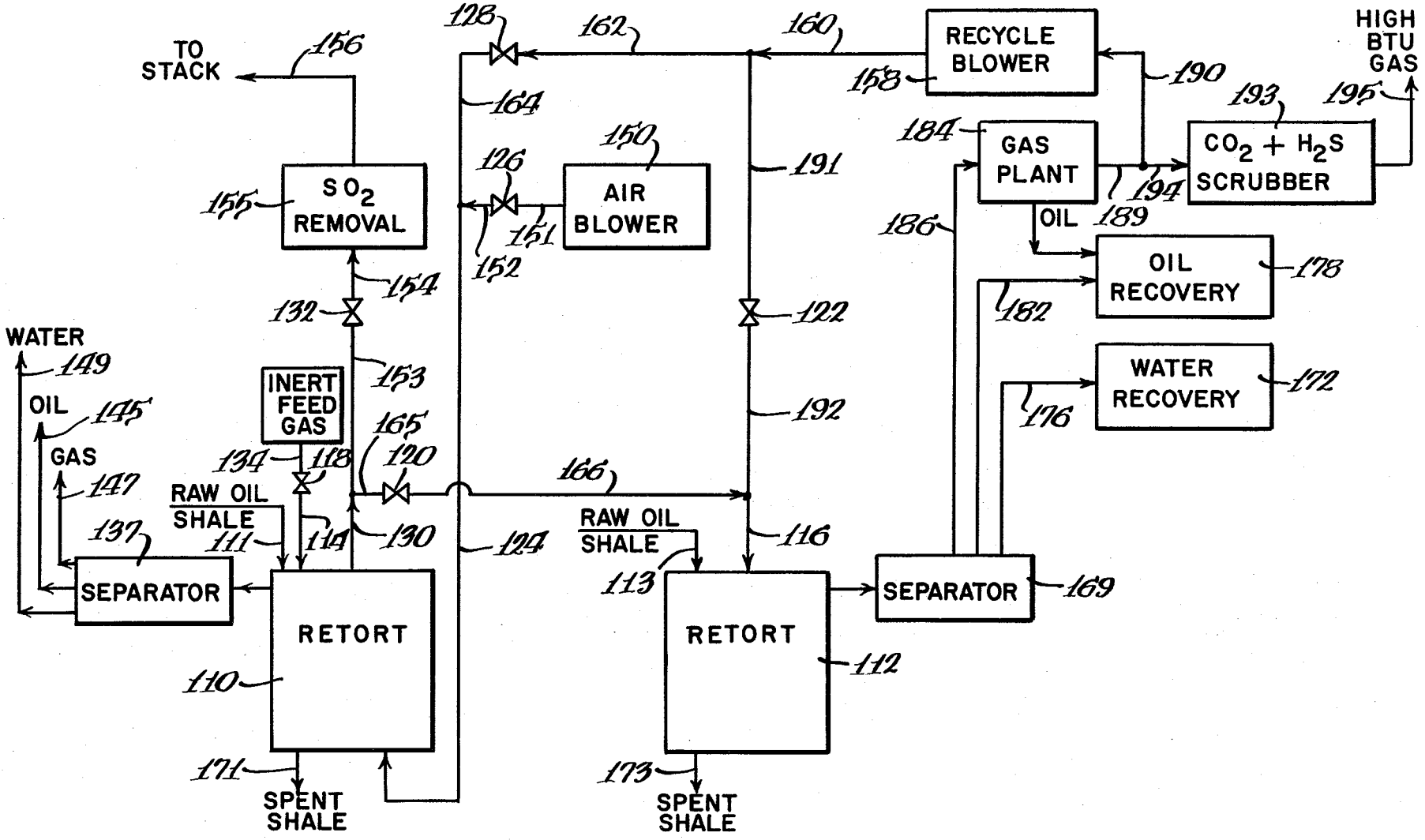
FIG. 3 is a schematic flow diagram of a huff and puff process for retorting oil shale above ground in accordance with principles of the present invention.

The huff and puff process shown in FIG. 3 is substantially similar to the huff and puff process shown in FIG. 1, except that the retorts 110 and 112 are above ground surface, batch sequential retorts and raw oil shale is dumped or otherwise fed downwardly into the retorts during retorting by raw shale feed lines 111 and 113, respectively. In the huff and puff process of FIG. 3, the influent retort off gases are injected upwardly into the retorts and the effluent product streams are separated in aboveground separators 137 and 169, such as API oil/-water separators. Spent shale is dumped from each retort, alternately, through outlets 171 and 173. The retort off gases can also be scrubbed of carbon dioxide and hydrogen sulfide before being recycled into the retorts. For ease of understanding and for clarity, the parts and components of the huff and puff process of FIG. 3 have been given part numbers similar to the parts and components of the huff and puff process of FIG. 1, except in the 100 series, such as air blower 150, recycle gas blower 158, etc.

In the illustrative huff and puff processes, the spent shale retorts are operated cyclically, alternating between an air blow cycle during which residual carbon on the retorted shale is burned, and a recycle gas flow cycle during which recycle off gases from the active retorts are heated in the spent retorts.

In a commercial operation, it is preferred to have numerous huff and puff retorts, such as 100 or so retorts over the course of a year arranged in a time sequence with each other so that the retort gases from a hot spent retort provide the gaseous heat carrier for an active retort.

Among the many advantages of the above in situ and surface huff and puff processes are:

1. Improved product yield and recovery.
2. Less loss of product oil.
3. Better retorting efficiency.
4. More simplified gas recovery.
5. Recovery of high BTU gas with low nitrogen content.

Although embodiments of this invention have been shown and described, it is to be understood that various modifications and substitutions, as well as rearrangements and combinations of process steps, can be made by those skilled in the art without departing from the novel spirit and scope of this invention.

What is claimed is:

1. A process for retorting oil shale, comprising the steps of:

completely retorting substantially all raw oil shale in a first oil shale retort without prior combustion of said oil shale therein with a hot inert feed gas to liberate shale oil and hydrocarbon gases from said raw oil shale leaving retorted shale;

preventing combustion in said first retort during retorting by substantially preventing air from entering said first retort until retorting has been completed in said first retort;

injecting off gases emitted from an oil shale retort through said first retort after said first retort has been completely retorted to heat said off gases to at least the retorting temperature of raw oil shale;

retorting raw oil shale in a second oil shale retort by feeding said heated off gases through said second retort to liberate shale oil from said raw oil shale in said second retort, while simultaneously preventing combustion in said second retort during retorting of said second retort by preventing a substantial amount of air and molecular oxygen from entering said second retort until retorting has been completed in said second retort to substantially prevent flame front ignition and burning of said shale oil in said second retort during said retorting of said second retort.

2. A process for retorting oil shale in accordance with claim 1 wherein said off gases are passed and fed into in situ retorts.

3. A process for retorting oil shale in accordance with claim 1 wherein said off gases are passed and fed into surface retorts.

4. A process in accordance with claim 1 wherein said inert feed gas is selected from the group consisting of retorting off gases, carbon dioxide and steam.

5. A process for retorting oil shale, comprising the steps of:

(a) retorting a first underground retort containing a rubblized mass of raw oil shale without prior combustion of said oil shale therein by injecting a hot inert feed gas in the absence of air and molecular oxygen substantially downwardly through said first underground retort containing said rubblized mass of raw oil shale at a sufficient temperature to liberate shale oil from said raw oil shale in said first underground retort leaving retorted oil shale containing carbon residue in said first underground retort;

(b) continue step (a) until substantially all of said raw oil shale in said first underground retort is retorted while substantially preventing air and molecular oxygen from entering said first underground retort to substantially prevent flame front ignition and shale oil burning in said first underground retort during retorting of said raw oil shale in said first underground retort;

(c) retorting a second underground retort containing another rubblized mass of raw oil shale by feeding heated off gases substantially free of nitrogen substantially downwardly through said second underground retort at a sufficient temperature to liberate shale oil and off gases from said raw oil shale in said second underground retort, while substantially preventing air and molecular oxygen from entering said second underground retort to substantially prevent flame front ignition and shale oil burning in said second underground retort during retorting of said second underground retort;

(d) withdrawing said shale oil and off gases from said second underground retort;

(e) separating a substantial amount of said shale oil and said off gases from said second underground retort in an underground sump; and (f) after substantially all of said raw oil shale in said first underground retort has been retorted, alternately passing air and said separated off gases from said second underground retort substantially upwardly through said first underground retort after step (b) to alternately combust said carbon residue in said first underground retort and heat said separated off gases in said first underground retort for use in step (c).

6. A process for retorting oil shale in accordance with claim 5 wherein said inert feed gas is off gases from an underground retort.

7. A process in accordance with claim 6 including deoiling said separated off gases in a gas plant before said off gases are passed through said first underground retort.

8. A process in accordance with claim 7 including removing a substantial amount of carbon dioxide and hydrogen sulfide from said off gases to substantially purify said off gases before said off gases are passed through said first underground retort.

* * * * *

UNITED STATES PATENT OFFICE

CERTIFICATE OF CORRECTION

Patent No. 4,452,689 Dated June 5, 1984

Inventor(s) Leonard W. Russum

It is certified that error appears in the above-identified patent and that said Letters Patent are hereby corrected as shown below:

| Patent Column | Line | |
|---|---|---|
| 1 | 12 | reads "hyrdocarbon-containing" and should read --hydrocarbon-containing-- |
| 1 | 13& 14 | reads "pryolysis" and should read --pyrolysis-- |
| 3 | 24 | reads "the" (second occurence) and should read --to-- |

Signed and Sealed this

*Sixteenth* Day of *July 1985*

[SEAL]

*Attest:*

DONALD J. QUIGG

*Attesting Officer* *Acting Commissioner of Patents and Trademarks*